US010808980B2

(12) United States Patent
Si et al.

(10) Patent No.: US 10,808,980 B2
(45) Date of Patent: Oct. 20, 2020

(54) ICE-MAKER/ICE STORAGE BOX ASSEMBLY AND REFRIGERATOR

(71) Applicants: HEFEI HUALING CO., LTD., Hefei (CN); MIDEA GROUP CO., LTD., Foshan (CN)

(72) Inventors: Zengqiang Si, Hefei (CN); Yang Shao, Hefei (CN); Zhengguang Lv, Hefei (CN); Hao Wang, Hefei (CN)

(73) Assignees: Hefei Hualing Co., Ltd., Hefei (CN); Media Group Co., Ltd., Foshan (CN)

( * ) Notice: Subject to any disclaimer, the term of this patent is extended or adjusted under 35 U.S.C. 154(b) by 76 days.

(21) Appl. No.: 16/200,232

(22) Filed: Nov. 26, 2018

(65) Prior Publication Data

US 2019/0145687 A1 May 16, 2019

Related U.S. Application Data

(63) Continuation of application No. PCT/CN2016/087286, filed on Jun. 27, 2016.

(30) Foreign Application Priority Data

May 27, 2016 (CN) ..... 2016 1 0383789

(51) Int. Cl.
*F25C 5/182* (2018.01)
*F25C 5/20* (2018.01)
(Continued)

(52) U.S. Cl.
CPC ..... *F25C 5/22* (2018.01); *F25C 5/02* (2013.01); *F25C 5/182* (2013.01); *F25C 5/24* (2018.01);
(Continued)

(58) Field of Classification Search
CPC .... F25C 5/22; F25C 5/182; F25C 5/24; F25C 5/02; F25C 1/147
See application file for complete search history.

(56) References Cited

U.S. PATENT DOCUMENTS

2010/0269533 A1* 10/2010 Hwang ..... F25C 5/22 62/344
2013/0340461 A1* 12/2013 Kang ..... F25C 5/046 62/321
2017/0292755 A1* 10/2017 Lee ..... F25C 5/24

FOREIGN PATENT DOCUMENTS

CN 101903719 A 12/2010
CN 103185431 A 7/2013
(Continued)

OTHER PUBLICATIONS

Hefei Hualing Co. Ltd., International Search Report and Written Opinion, PCT/CN2016/087286, dated Mar. 7, 2017, 13 pgs.
(Continued)

*Primary Examiner* — Elizabeth J Martin
*Assistant Examiner* — Nael N Babaa
(74) *Attorney, Agent, or Firm* — Morgan, Lewis & Bockius LLP

(57) ABSTRACT

An ice-maker/ice storage box assembly and a refrigerator having the ice-maker/ice storage box assembly are provided. The ice-maker/ice storage box assembly has an ice storage box. The ice storage box is provided with a rotary shaft and a separation mechanism. An outer end of the rotary shaft is provided with a rotary-shaft connector. The rotary-shaft connector is connected to a transmission connector of an ice dispensing motor. The separation mechanism is used to axially separate the transmission connector from the rotary-shaft connector. The ice-maker/ice storage box assembly enables the ice storage box to be conveniently removed without damaging a connection part between the ice dis-
(Continued)

pensing motor and the ice storage box, and the ice storage box does not have to be removed in a fixed direction.

15 Claims, 6 Drawing Sheets

(51) Int. Cl.
*F25C 5/02* (2006.01)
*F25D 23/02* (2006.01)
*F25C 1/147* (2018.01)

(52) U.S. Cl.
CPC ..... *F25D 23/028* (2013.01); *F25C 1/147* (2013.01); *F25C 2305/022* (2013.01); *F25C 2400/10* (2013.01); *F25C 2500/02* (2013.01)

(56) References Cited

FOREIGN PATENT DOCUMENTS

| | | | |
|---|---|---|---|
| CN | 104006595 | A | 8/2014 |
| KR | 20100138091 | A | 12/2010 |
| KR | 20110038369 | A | 4/2011 |

OTHER PUBLICATIONS

Hefei Hualing Co. Ltd., International Preliminary Report on Patentability, PCT/CN2016/087286, dated Nov. 27, 2018, 4 pgs.

* cited by examiner

ICE-MAKER/ICE STORAGE BOX ASSEMBLY AND REFRIGERATOR

CROSS-REFERENCE TO RELATED APPLICATIONS

This application is a continuation application of PCT Patent Application No. PCT/CN2016/087286, entitled "ICE-MAKER/ICE STORAGE BOX ASSEMBLY AND REFRIGERATOR" filed on Jun. 27, 2016, which claims priority to Chinese Patent Application No. 201610383789.2, entitled "ICE-MAKER/ICE STORAGE BOX ASSEMBLY AND REFRIGERATOR" filed with the Chinese Patent Office on May 27, 2016, all of which are incorporated herein by reference in their entirety.

TECHNICAL FIELD

The present disclosure relates to the technical field of refrigerator, and particularly to an ice-maker/ice storage box assembly and a refrigerator.

BACKGROUND

At present, the detaching directions of an ice storage box mainly include the vertical direction and the horizontal direction. One of the detaching directions is, as disclosed in Patent No. CN200910258882.0, that an ice-maker is mounted on the back of a door liner, an ice storage box (ice storage bucket) is detachably mounted below the ice-maker in the horizontal direction, a motor is mounted on the door liner, i.e., the movement track of the ice storage box is perpendicular to the horizontal direction of the door liner, that is, the ice storage box is mounted on the door liner in a direction perpendicular to the door liner (the horizontal direction). The other detaching direction is that, a motor shaft is vertically mounted on the door liner and the ice storage box is detachably connected to the motor shaft in the vertical direction. However, regardless of the installation types, when the ice storage box are disassembled from the ice dispensing motor, it is necessary to pull out the ice storage box in a fixed direction (for example, only in the horizontal direction or only in the vertical direction). If the ice storage box is inserted and pulled out for a long time, the connection portion between the ice dispensing motor and the ice storage box is easy to be worn, resulting in a loose connection.

SUMMARY

The technical problems to be solved by the present disclosure are how to facilitate the removing of the ice storage box without damaging the connection portion between the ice dispensing motor and the ice storage box; and how to remove the ice storage box without the limitation of a fixed direction.

In order to solve the technical problems above, the present disclosure provides an ice-maker/ice storage box assembly including an ice storage box, which; wherein the ice storage box is provided with a rotary shaft and a separation mechanism; an outer end of the rotary shaft is provided with a rotary-shaft connector for connecting to a transmission connector of an ice dispensing motor; the separation mechanism is configured to axially separate the transmission connector from the rotary-shaft connector.

Wherein, the separation mechanism includes a pressing connecting arm, a pressing block and a fixing base shell; one end of the pressing connecting arm is arranged correspondingly to the rotary-shaft connector for moving the rotary-shaft connector along an axial direction of the rotary shaft; the pressing block is fixedly connected to the other end of the pressing connecting arm; the fixing base shell is fixed on the ice storage box, and the pressing block is connected to the fixing base shell.

Wherein, one end of the rotary-shaft connector close to the ice storage box is provided with a blocking plate.

Wherein, the rotary-shaft connector is connected to the blocking plate through a connecting sleeve; one end of the pressing connecting arm is arranged opposite to one side of the blocking plate, and there is a gap between the pressing connecting arm and the connecting sleeve.

Wherein, an elastic resetting member is sleeved on the rotary shaft between the rotary-shaft connector and the ice storage box.

Wherein, the elastic resetting member is a resetting spring.

Wherein, an outer end of the rotary shaft is provided with an external thread, which is connected to a nut for preventing the rotary-shaft connector from shedding.

Wherein, a limiting protrusion is provided on the pressing block, and a limiting slot corresponding to the limiting protrusion is provided on the fixing base shell.

The present disclosure also provides a refrigerator, including a door liner, an ice-making compartment, an ice-maker, an ice dispensing motor and the ice-maker/ice storage box assembly above, the ice-making compartment being mounted on the door liner, the ice-maker being mounted at an upper portion within the ice-making compartment, the ice dispensing motor being mounted at a lower portion within the ice-making compartment; wherein the refrigerator further comprises the ice-maker/ice storage box assembly of any one of claims 1-8, and one end of the ice dispensing motor is connected to a transmission connector connected to the rotary-shaft connector, and a lower end of the ice storage box is positioned on a lower end of the ice-making compartment; when the ice storage box is removed, the rotary-shaft connector is separated from the transmission connector by the separation mechanism.

Wherein, the transmission connector is mounted on a motor shaft of the ice dispensing motor.

Compared to the prior art, the present disclosure has the following advantages:

The present disclosure provides an ice-maker/ice storage box assembly and a refrigerator, wherein the ice-maker/ice storage box assembly is improved on the basis of the structure of the existing ice storage box assembly. A rotary shaft and a separation mechanism are provided on the ice storage box, a rotary-shaft connector is provided at an outer end of the rotary shaft, the rotary-shaft connector is configured to be connected to a transmission connector of the ice dispensing motor; the separation mechanism is configured to axially separate the transmission connector from the rotary-shaft connector; when the ice storage box is required to be removed, the rotary-shaft connector is axially separated from the transmission connector by the separation mechanism, so that the ice storage box can be conveniently removed without damaging a connection portion between the ice dispensing motor and the ice storage box; after the rotary-shaft connector is separated from the transmission connector, the ice storage box can be removed in any direction without the limitation of the detaching directions.

Figure 1:
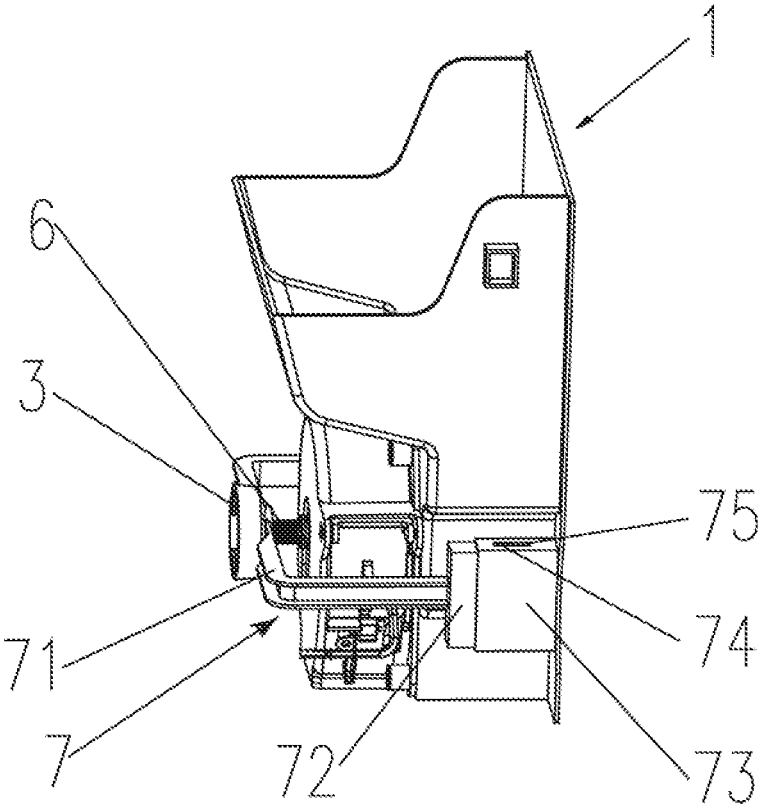
FIG. 1 is a stereogram of an ice-maker/ice storage box assembly of the present disclosure.
Figure 2:
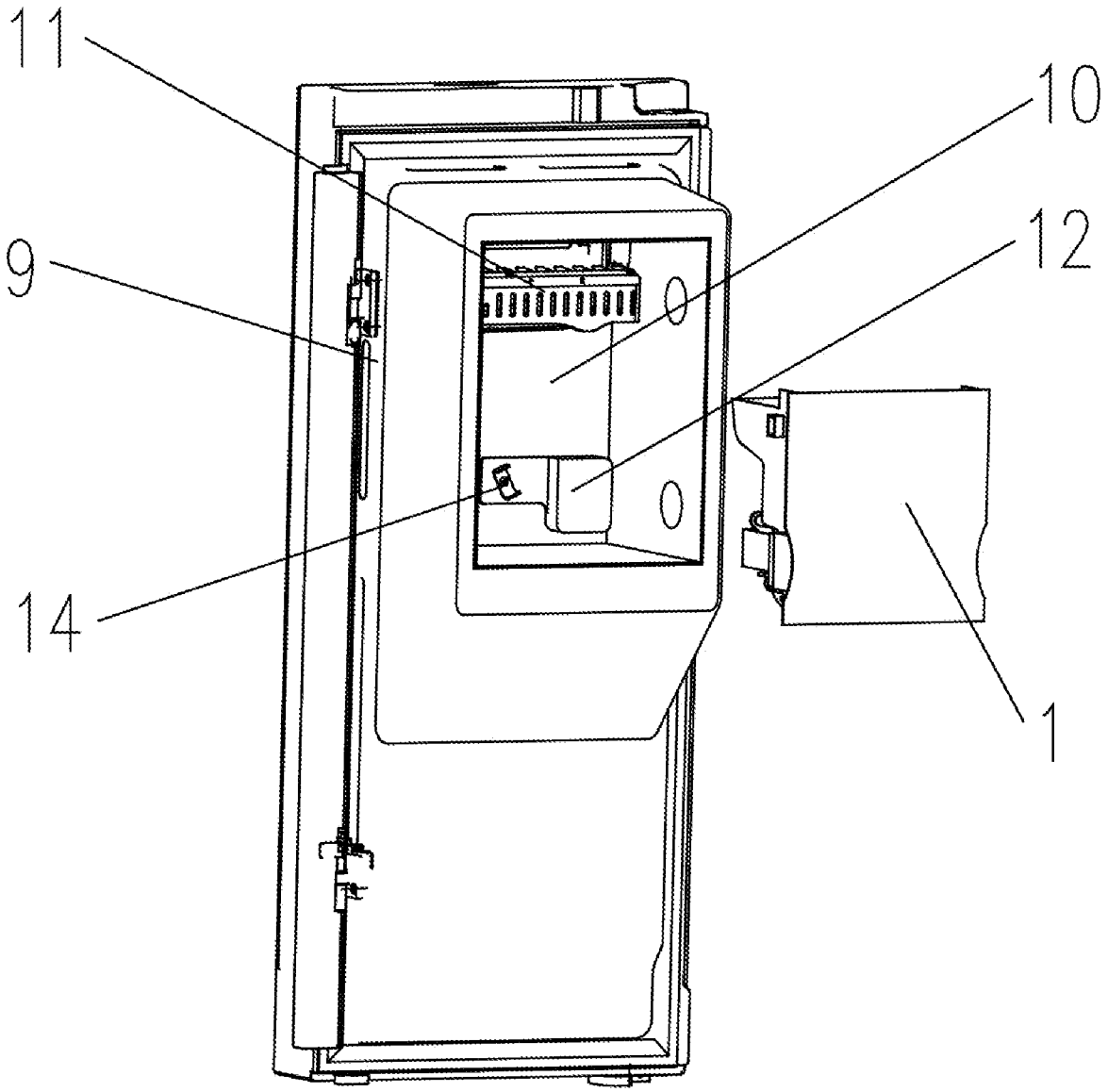
FIG. 2 is a diagram of an ice-maker/ice storage box assembly of the present disclosure before it is assembled with an ice dispensing motor or after it is separated from the ice dispensing motor.
Figure 3:
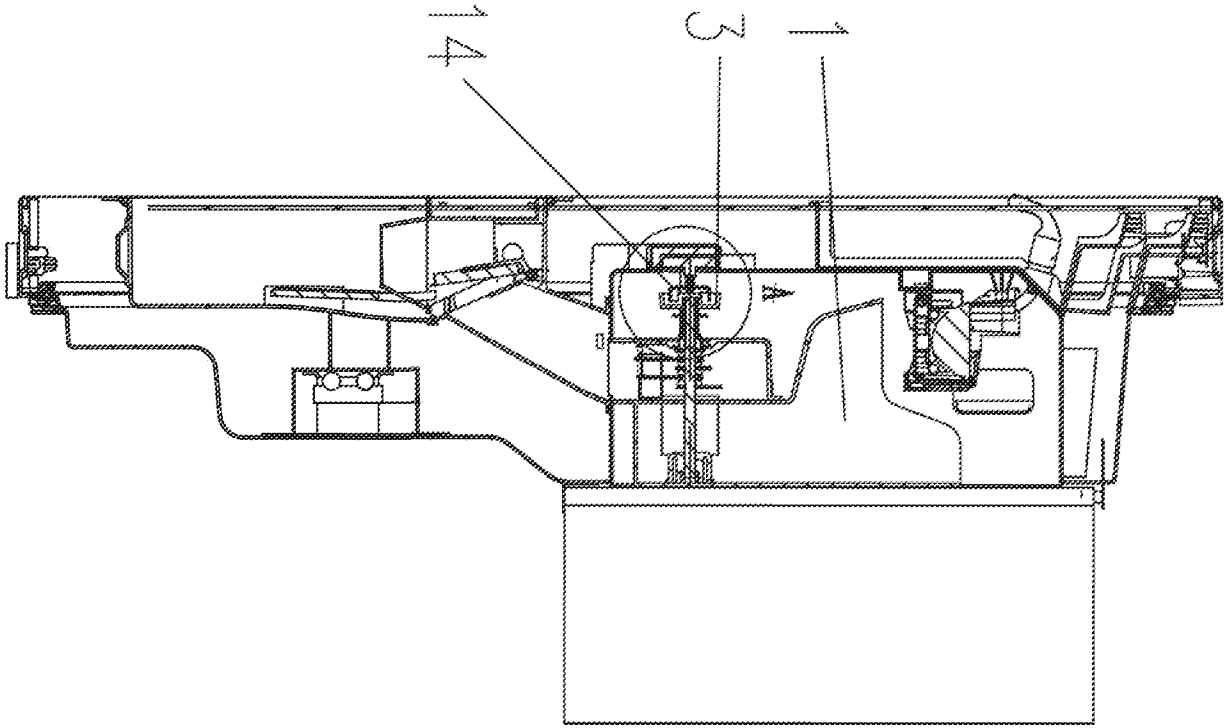
FIG. 3 is sectional view of a refrigerator (the rotary-shaft connector is connected to the transmission connector) of the present disclosure.

In the drawings: 1: ice storage box; 2: rotary shaft; 3: rotary-shaft connector; 4: blocking plate; 5: connecting sleeve; 6: elastic resetting member; 7: separation mechanism; 71: pressing connecting arm; 72: pressing block; 73: fixing base shell; 74: limiting protrusion; 75: limiting slot; 8: nut; 9: door liner; 10: ice-making compartment; 11: ice-maker; 12: ice dispensing motor; 13: motor shaft; 14: transmission connector; 15: bolt.

DETAILED DESCRIPTION

The specific implementation manners of the present disclosure will be further described in detail with reference to the accompanying drawings and embodiments. The following examples are used to illustrate the present disclosure, but are not intended to limit the scope thereof.

It should be noted that, in the description of the present disclosure, the orientation or position relations indicated by the terms "center", "longitudinal", "lateral", "upper", "lower", "front", "rear", "left", "right", "vertical", "horizontal", "top", "bottom", "inner", "outer" etc. are relative to the operator. The side in front of the operator is "front", the side away from the operator is "rear", which is merely for the convenience of describing the present disclosure and simplifying the description, and is not to indicate or imply that the device or component referred to must have a specific orientation, and is constructed and operated in a specific orientation. Therefore, it cannot be construed as limiting the present disclosure.

In the description of the present disclosure, it should be noted that unless specifically defined or limited, the terms "mount", "connect to", and "connect with" should be understood in a broad sense, for example, they may be fixed connections or may be removable connections or integrated connections; may be mechanical connections or electrical connections; they may also be direct connections or indirect connections through intermediate medium, or may be internal communication between two components. For a person of ordinary skill in the art, the specific meanings of the terms above in the present disclosure can be understood according to specific situations.

In addition, unless specified otherwise, "a plurality of" and "a plurality of sets" means two or more in the description of the present disclosure.

As shown in FIG. 1-FIG. 6, the ice-maker/ice storage box assembly provided by the present disclosure includes an ice storage box 1, wherein the ice storage box 1 is provided with a separation mechanism 7 and a rotary shaft 2 vertical to a mounting surface of the ice storage box 1. The mounting surface may be a side surface or a bottom surface of the ice storage box 1. An end of the rotary shaft 2 extends into the ice storage box 1 and the other end of the rotary shaft 2 extends out of the ice storage box 1. The outer end of the rotary shaft 2 (i.e., the rotary shaft 2 portion outside the ice storage box 1) is provided with a rotary-shaft connector 3 for connecting to a transmission connector 14 of an ice dispensing motor 12. The separation mechanism 7 is used to axially separate the transmission connector 14 from the rotary-shaft connector 3, so that the ice storage box 1 can be removed conveniently. In order to ensure a steady separation, the separation mechanisms 7 can be symmetrically disposed on both sides of the rotary-shaft connector 3.

Figure 4:
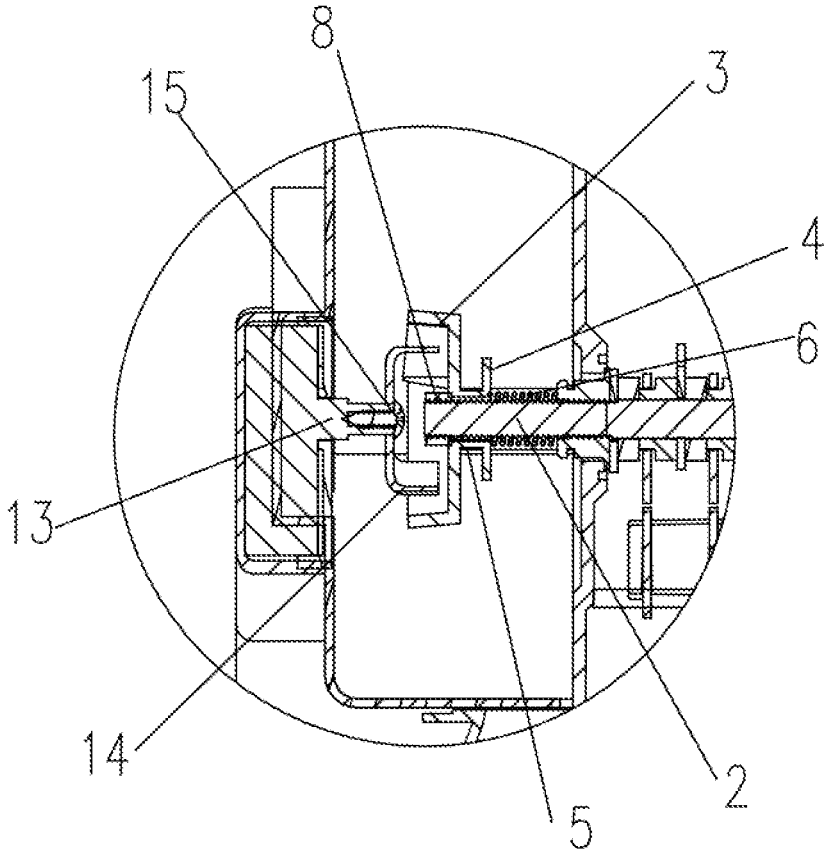
FIG. 4 is a partial enlarged view of A in FIG. 3.
Figure 5:
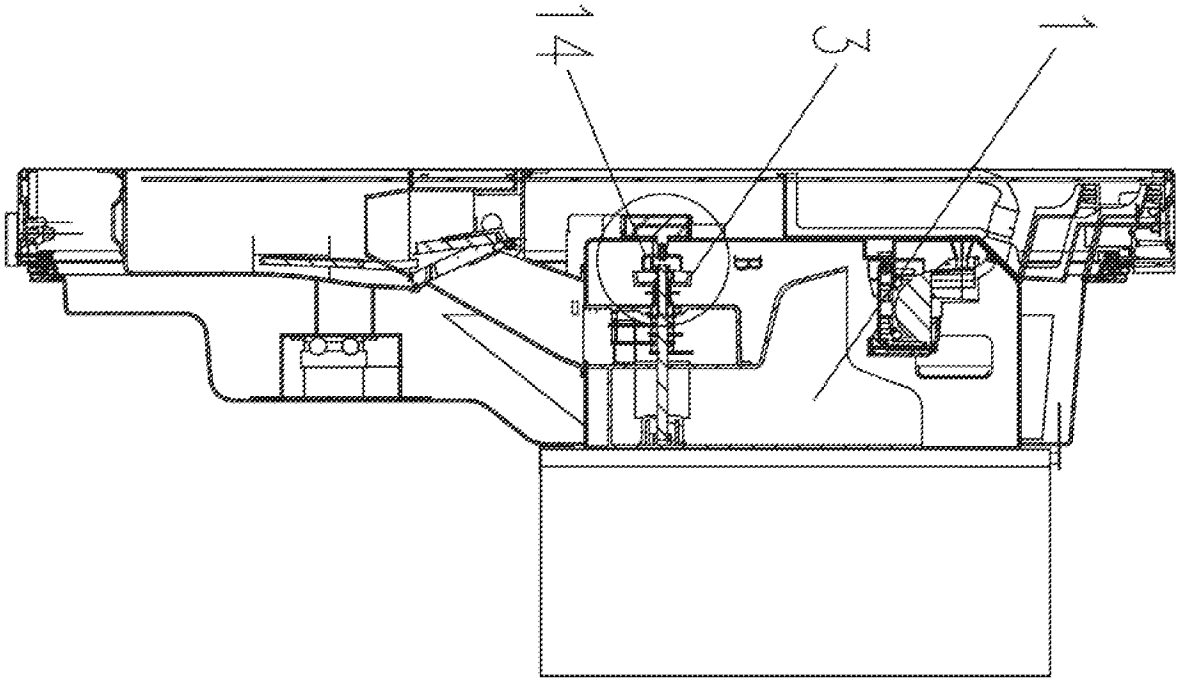
FIG. 5 is sectional view of a refrigerator (the rotary-shaft connector is separated from the transmission connector) of the present disclosure.

Specifically, as shown in FIG. 1 and FIG. 4, the separation mechanism 7 may include a pressing connecting arm 71, a pressing block 72 and a fixing base shell 73. One end of the pressing connecting arm 71 is arranged correspondingly to the rotary-shaft connector 3 for moving the rotary-shaft connector 3 along an axial direction of the rotary shaft 2, so as to axially separate the transmission connector 14 from the rotary-shaft connector 3; alternatively, one end of the pressing connecting arm 71 may also be arranged correspondingly to the transmission connector 14 for moving the transmission connector 14 along an axial direction of the ice dispensing motor 12, so as to axially separate the transmission connector 14 from the rotary-shaft connector 3. The pressing block 72 is fixedly connected to the other end of the pressing connecting arm 71, the fixing base shell 73 is fixed on the ice storage box 1, and the pressing block 72 is connected to the fixing base shell 73. In order to facilitate the connection between the pressing connecting arm 71 and the rotary-shaft connector 3, one end of the rotary-shaft connector 3 close to the ice storage box 1 is provided with a blocking plate 4 and the rotary-shaft connector 3 is connected to the blocking plate 4 through a connecting sleeve 5. One end of the pressing connecting arm 71 is arranged opposite to one side of the blocking plate 4, and there is a gap between the pressing connecting arm 71 and the connecting sleeve 5, so that it is convenient for pushing the blocking plate 4 by the pressing connecting arm 71 and the rotation of the rotary-shaft connector 3 will not be interfered. Of course, the blocking plate 4 and the connecting sleeve 5 may also be provided on the transmission connector 14 in a same manner, one end of the pressing connecting arm 71 is arranged opposite to one side of the blocking plate 4, and there is a gap between the pressing connecting arm 71 and the connecting sleeve 5, so that it is convenient for pushing the blocking plate 4 by the pressing connecting arm 71 and the rotation of the transmission connector 14 will not be interfered. Of course, the separation mechanism 7 may also adopt other structures, as long as the rotary-shaft connector 3 can be separated from the transmission connector 14.

Figure 6:
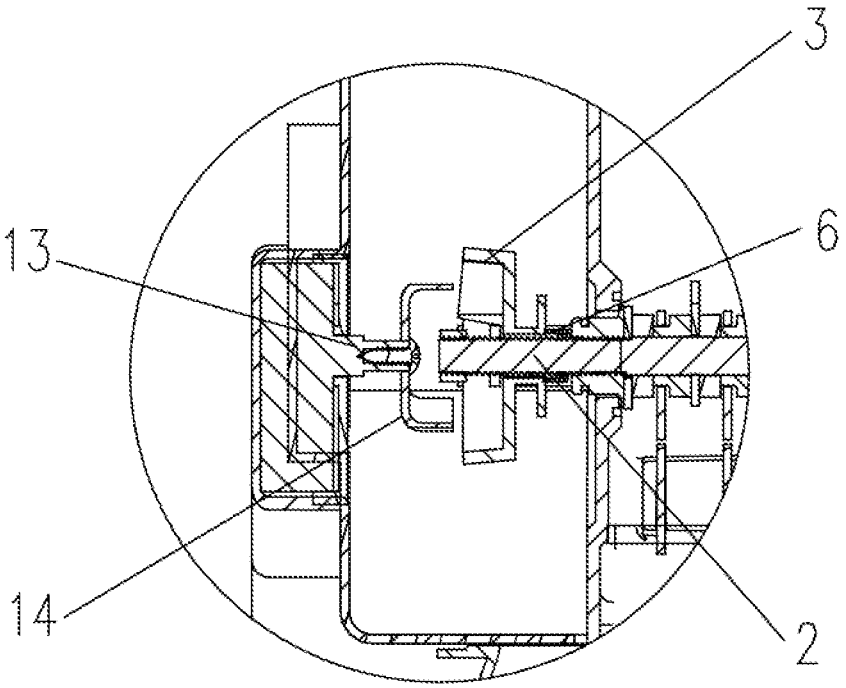
FIG. 6 is a partial enlarged view of B in FIG. 5.

As shown in FIG. 1, FIG. 4 and FIG. 6, an elastic resetting member 6, such as a resetting spring, may be sleeved on the rotary shaft 2 between the rotary-shaft connector 3 and the ice storage box 1, the elastic resetting member 6 is arranged so that the separation mechanism 7 and the rotary-shaft connector 3 can be reset. In addition, a blocking ring may also be provided at the junction between the ice storage box 1 and the rotary shaft 2. One end of the elastic resetting member 6 is withstood by the blocking ring, so that the mounting surface is prevented from being worn due to the long-time use of the elastic resetting member 6. Further, a limiting protrusion 74 may be provided on the pressing block 72, and a limiting slot 75 corresponding to the limiting protrusion 74 is provided on the fixing base shell 73. When the pressing block 72 is pressed, the limiting protrusion 74 is stuck in the limiting slot 75 for positioning. Of course, an elastic member facilitating the returning may also be provided at the junction between the pressing block 72 and the fixing base shell 73.

Specifically, as shown in FIG. 4, the outer end of the rotary shaft 2 may be provided with an external thread, which is connected to a nut 8 for preventing the rotary-shaft connector 3 from shedding, the rotary-shaft connector 3 is limited by the nut 8. Of course, the rotary shaft 2 may also be provided without the external thread, instead, the nut 8 or other limiting members are directly welded at the outer end of the rotary shaft 2.

Preferably, as shown in FIG. 1, the pressing connecting arm 71 is in an L-shape and a corner of the pressing connecting arm 71 is provided with a transitional cambered surface. The corner of the pressing connecting arm 71 corresponds to a corner of the ice storage box 1, so that the structure is compact.

As shown in FIG. 1-FIG. 6, the present disclosure further provides a refrigerator, including a door liner 9, an ice-making compartment 10, an ice-maker 11, an ice dispensing motor 12 and the ice-maker/ice storage box assembly described above. The ice-making compartment 10 is mounted on the door liner 9. The ice-maker 11 is mounted at an upper portion within the ice-making compartment 10. The ice dispensing motor 12 is mounted at a lower portion within the ice-making compartment 10. The ice storage box 1 is mounted in the ice-making compartment 10 and below the ice-maker 11. A motor shaft 13 of the ice dispensing motor 12 is provided vertical to the mounting surface of the ice dispensing motor 12 which may be an upper surface of the lower end of the ice-making compartment 10 or a side surface parallel to the door liner 9 in the ice-making compartment 10. When the mounting surface of the ice dispensing motor 12 is the upper surface of the lower end of the ice-making compartment 10, a mounting surface of the ice storage box 1 is a corresponding bottom surface of the ice storage box 1; when the mounting surface of the ice dispensing motor 12 is the side surface parallel to the door liner 9 in the ice-making compartment 10, the mounting surface of the ice storage box 1 is a corresponding side surface of the ice storage box 1. That is, the motor shaft 13 may be provided vertical to the door liner 9 or parallel to the door liner 9. An end of the ice dispensing motor 12 is connected to a transmission connector 14 connected to the rotary-shaft connector 3 correspondingly. A lower end of the ice storage box 1 is positioned on the lower end of the ice-making compartment 10, so that other mounting and connecting members are not required and the mounted ice storage box 1 is stable and reliable. When the ice storage box 1 needs to be removed, by separating the rotary-shaft connector 3 from the transmission connector 14 with the separation mechanism 7, the ice storage box 1 can be removed conveniently without damaging a connection portion between the ice dispensing motor 12 and the ice storage box 1. After the rotary-shaft connector 3 is separated from the transmission connector 14, the ice storage box 1 can be removed in any direction without the limitation of the detaching directions. Moreover, the mounted ice storage box 1 is not easy to fall off.

In order to facilitating the mounting of the transmission connector 14, the transmission connector 14 is mounted on the motor shaft 13 of the ice dispensing motor 12. Specifically, an end portion of the motor shaft 13 in axial direction may be provided with a threaded blind hole in which a bolt 15 is connected, and the transmission connector 14 is mounted on the motor shaft 13 through the bolt 15.

It can be seen from the embodiments above that, the ice storage box 1 of the present disclosure can be removed conveniently without the limitation of the detaching direction. Further, the mounted ice storage box 1 is not easy to fall off and the mounting is reliable.

The above are only preferred embodiments of the present disclosure, and are not intended to limit the present disclosure. Any modifications, equivalent replacements and improvements made within the spirit and principle of the present application shall be within the protection scope of the present application.

What is claiming is:

1. An ice-maker/ice storage box assembly, comprising:

an ice storage box, wherein the ice storage box is provided with a rotary shaft and a separation mechanism, an outer end of the rotary shaft is provided with a rotary-shaft connector for connecting to a transmission connector of an ice dispensing motor, and the separation mechanism is configured to axially separate the transmission connector from the rotary-shaft connector, wherein the separation mechanism comprises a pressing connecting arm, a pressing block and a fixing base shell; one end of the pressing connecting arm is arranged correspondingly to the rotary-shaft connector for moving the rotary-shaft connector along an axial direction of the rotary shaft the pressing block is fixedly connected to the other end of the pressing connecting arm; and the fixing base shell is fixed on the ice storage box and the pressing block is connected to the fixing base shell.

2. The ice-maker/ice storage box assembly of claim 1, wherein one end of the rotary-shaft connector is provided with a blocking plate.

3. The ice-maker/ice storage box assembly of claim 2, wherein the rotary-shaft connector is connected to the blocking plate through a connecting sleeve; one end of the pressing connecting arm is arranged opposite to one side of the blocking plate, and there is a gap between the pressing connecting arm and the connecting sleeve.

4. The ice-maker/ice storage box assembly of claim 1, wherein an elastic resetting member is sleeved on the rotary shaft between the rotary-shaft connector and the ice storage box.

5. The ice-maker/ice storage box assembly of claim 4, wherein the elastic resetting member is a resetting spring.

6. The ice-maker/ice storage box assembly of claim 1, wherein an outer end of the rotary shaft is provided with an external thread which is connected to a nut for preventing the rotary-shaft connector from shedding.

7. The ice-maker/ice storage box assembly of claim 1, wherein a limiting protrusion is provided on the pressing block, and a limiting slot corresponding to the limiting protrusion is provided on the fixing base shell.

8. A refrigerator, comprising:

a door liner, an ice-making compartment, an ice-maker and an ice dispensing motor, the ice-making compartment being mounted on the door liner, the ice-maker being mounted at an upper portion within the ice-making compartment, the ice dispensing motor being mounted at a lower portion within the ice-making compartment; and an ice storage box, wherein the ice storage box is provided with a rotary shaft and a separation mechanism, an outer end of the rotary shaft is provided with a rotary-shaft connector for connecting to a transmission connector of the ice dispensing motor, and the separation mechanism is configured to axially separate the transmission connector from the rotary-shaft connector, wherein:

one end of the ice dispensing motor is connected to the transmission connector connected to the rotary-shaft connector, and a lower end of the ice storage box is positioned on a lower end of the ice-making compartment; when the ice storage box is removed, the rotary-shaft connector is separated from the transmission connector by the separation mechanism, wherein the separation mechanism comprises a pressing connecting arm, a pressing block and a fixing base shell; one end of the pressing connecting arm is arranged correspondingly to the rotary-shaft connector for moving the rotary-shaft connector along an axial direction of the rotary shaft the pressing block is fixedly connected to the other end of the pressing connecting arm; and the fixing base shell is fixed on the ice storage box and the pressing block is connected to the fixing base shell.

9. The refrigerator of claim 8, wherein the transmission connector is mounted on a motor shaft of the ice dispensing motor.

10. The refrigerator of claim 8, wherein one end of the rotary-shaft connector close to the ice storage box is provided with a blocking plate.

11. The refrigerator of claim 10, wherein the rotary-shaft connector is connected to the blocking plate through a connecting sleeve; one end of the pressing connecting arm is arranged opposite to one side of the blocking plate, and there is a gap between the pressing connecting arm and the connecting sleeve.

12. The refrigerator of claim 8, wherein an elastic resetting member is sleeved on the rotary shaft between the rotary-shaft connector and the ice storage box.

13. The refrigerator of claim 12, wherein the elastic resetting member is a resetting spring.

14. The refrigerator of claim 8, wherein an outer end of the rotary shaft is provided with an external thread which is connected to a nut for preventing the rotary-shaft connector from shedding.

15. The refrigerator of claim 8, wherein a limiting protrusion is provided on the pressing block, and a limiting slot corresponding to the limiting protrusion is provided on the fixing base shell.

* * * * *